US005984571A

United States Patent [19]

Owens

[11] Patent Number: 5,984,571

[45] Date of Patent: Nov. 16, 1999

[54] VIBRATING SCREED

[75] Inventor: Joe M. Owens, Aurora, Ill.

[73] Assignee: Cleform Tool Company, St Joseph, Mo.

[21] Appl. No.: 08/962,177

[22] Filed: Oct. 31, 1997

[51] Int. Cl.[6] ..... E01C 19/24

[52] U.S. Cl. ..... 404/97; 404/114; 404/118; 15/235.8

[58] Field of Search ..... 404/96, 97, 114, 404/118; 15/235.4, 235.8

[56] References Cited

U.S. PATENT DOCUMENTS

| | | | |
|---|---|---|---|
| 919,993 | 4/1909 | Worthington . | |
| 1,955,101 | 4/1934 | Sloan . | |
| 2,180,198 | 11/1939 | Day . | |
| 2,255,343 | 9/1941 | Baly . | |
| 2,303,335 | 12/1942 | Day . | |
| 2,314,985 | 3/1943 | Jackson . | |
| 2,372,163 | 3/1945 | Whitman . | |
| 2,386,662 | 10/1945 | Crock . | |
| 2,400,321 | 5/1946 | Troxell . | |
| 2,651,980 | 9/1953 | Wells et al. . | |
| 2,746,367 | 5/1956 | Ferguson . | |
| 2,999,261 | 9/1961 | Lapham . | |
| 3,427,939 | 2/1969 | Braff et al. . | |
| 3,883,259 | 5/1975 | Berg et al. . | |
| 3,917,426 | 11/1975 | Wohlwend et al. . | |
| 4,043,694 | 8/1977 | Mullen . | |
| 4,155,141 | 5/1979 | Guerra | 15/235.8 |
| 4,349,295 | 9/1982 | Morrison . | |
| 4,359,296 | 11/1982 | Cronkhite . | |
| 4,375,351 | 3/1983 | Allen . | |
| 4,386,901 | 6/1983 | Morrison . | |
| 4,388,018 | 6/1983 | Boschung . | |
| 4,397,581 | 8/1983 | Jarvis | 404/97 |
| 4,427,358 | 1/1984 | Stilwell . | |
| 4,591,291 | 5/1986 | Owens . | |
| 4,641,995 | 2/1987 | Owens . | |
| 4,650,366 | 3/1987 | Morrison . | |
| 4,685,826 | 8/1987 | Allen . | |
| 4,758,114 | 7/1988 | Artzberger . | |
| 4,798,494 | 1/1989 | Allen . | |
| 4,838,730 | 6/1989 | Owens . | |
| 4,848,961 | 7/1989 | Rouillard . | |
| 4,861,188 | 8/1989 | Rouillard . | |
| 4,911,575 | 3/1990 | Tidwell . | |
| 5,096,330 | 3/1992 | Artzberger . | |
| 5,244,305 | 9/1993 | Lindley . | |
| 5,375,942 | 12/1994 | Lindley et al. . | |
| 5,540,519 | 7/1996 | Weber | 404/102 |
| 5,857,803 | 1/1999 | Davis et al. | 404/102 |

FOREIGN PATENT DOCUMENTS

| | | |
|---|---|---|
| 141685 | 6/1951 | Australia . |
| 1227346 | 8/1960 | France . |
| 173454 | 11/1960 | Sweden . |
| 613900 | 12/1948 | United Kingdom . |
| 618510 | 2/1949 | United Kingdom . |
| 2192418 | 1/1988 | United Kingdom . |

*Primary Examiner*—James A. Lisehora
*Attorney, Agent, or Firm*—Hovey, Williams, Timmons & Collins

[57] ABSTRACT

A vibrating screed is provided which permits selective adjustment of the angle between the axis of a rotatable eccentric and the plane defined by the bottom of the screed plate to vary the relative vertical compaction and horizontal smoothing oscillation movement imparted by the eccentric. The screed includes a frame, motor, an eccentric driven by the motor, a screed plate, and a pair of locking hinges which releasably connect the frame to the screed plate at one of a multiplicity of possible angular relationships therebetween. The screed plate includes a tension adjustment to facilitate leveling of the screed and the weight of the eccentric is positioned between two spaced-apart bearings for enhanced support and for enabling the axis of rotation of the eccentric to be varied relative to the screed plate.

14 Claims, 3 Drawing Sheets

VIBRATING SCREED

BACKGROUND OF THE INVENTION

1. Field of the Invention

This invention broadly concerns a vibrating screed used in compacting and smoothing flowable cementatious materials. More particularly, it is concerned with a vibrating screed which provides for improved and adjustable control by the operator over the relative vertical compacting and horizontal screeding forces applied to the material.

2. Description of the Prior Art

Various tools for working cementatious material into a finished shape for hardening are well known in the art. Such cementatious material is most commonly concrete which includes crushed rock or gravel as an aggregate. In finishing surfaces such as roads, walkways, foundations and the like, it is often desirable to both compact the mortar around the aggregate to consolidate and thereby densify the concrete, as well as smooth the upper surface to present a finished appearance.

In addition to trowels, smoothers and bull floats, powered screeds have been developed which aid in working the flowable concrete or other cementations material. These various devices include screeds powered by an electric motor, internal combustion engine or a pneumatic oscillator which are pushed or driven across the surface of the material to compact and smooth the material to a finished surface. Examples of such screeds are shown, for example, in my U.S. Pat. Nos. 4,591,291, 4,340,351 and 4,752,156.

As shown in my U.S. Pat. No. 4,591,291 referenced above and in U.S. Pat. No. 5,244,305, portable screeds which may be operated by a single operator and moved along the surface of the wet concrete are useful in finishing small to medium sized concrete pours. These screeds advantageously smooth and finish the surface using lightweight motors or engines which rotate use an eccentric to impart oscillating motion and thereby provide a finished surface. However, such devices have operating limitations which have given rise to the need for an improved portable screed. For example, the forces imparted by the eccentric on these existing portable screeds may cause accelerated wear on the bearing surfaces, may lack the ability to select a setting for imparting different amounts of compaction and smoothing, or may be incapable of providing both compaction and horizontal smoothing functions.

Accordingly, there has developed a need for an improved vibrating screed which can be easily transported and positioned by a single operator.

There additionally has developed a need for a portable screed which provides both compacting force as well as a smoothing force.

There is an additional need for a portable vibrating screed with an improved screed plate for smoothing an compacting operation.

There is yet a further need for a portable screed capable of selective adjustment to provide different ratios of consolidation to horizontal smoothing operation.

SUMMARY OF THE INVENTION

These and other needs are largely met by the vibrating screed in accordance with the present invention. That is to say, the vibrating screed hereof is relatively light in weight, capable of operation by a single operator, includes an improved screed plate for providing a more efficient smoothing operation, and is selectively adjustable to vary the relative consolidation and smoothing forces applied to the poured cement.

Broadly speaking, the vibrating screed in accordance with the present invention includes a frame having a handle for manipulation by the operator, a power member or motor for providing rotational power, a screed plate, an eccentric rotatably driven by the motor, and a locking hinge selectively adjustably mounting the screed plate to the frame. The locking hinge includes a securing mechanism for fixing the angle of the screed plate at one of a selected number of different angles relative to the frame for controlling the angle and thereby the portion of the force applied by the eccentric to the screed plate for compaction relative to smoothing. The screed hereof thus allows the operator to preselect the angle between the axis of rotation of the eccentric and the bottom of the screed plate to provide a desired ratio combining both compaction and oscillation.

More particularly, the locking hinge includes a pair of laterally spaced knuckles mounted to the screed plate and a pair of adjacent connectors on the frame and interconnected to the knuckles by a pin or bolt. Each of the connectors and their respective knuckles are provided with faces presenting opposing teeth for interlocking engagement when the bolt is tightened to fix the relative angle between the knuckle and the bracket and thus the frame and the bottom of the screed plate. As a result, the operator may select from one of a multiplicity of different angular relationships for the force imparted by the eccentric to the screed plate, thereby also varying the ratio between the compaction (vertical) and smoothing oscillation (horizontal).

Most desirably, the frame of the screed hereof includes spaced apart bearings for carrying the journals of the eccentric with the eccentric weight positioned therebetween. The eccentric is thus rotatable around an axis which is supported on either side of the weight. This is especially beneficial when both compacting and smoothing action is being performed. The motor is preferably controllable by a throttle mounted on the handle to operate at different rotational speeds to vary the amount of force imparted by the eccentric to the screed plate.

In preferred embodiments, the screed plate is provided with a substantially flat bottom bearing surface and an cutting shoe presenting a lower relatively sharp edge and a recess. The bottom bearing surface is preferably wide having a width of about 10" in the most preferred embodiments. The ends of the bottom bearing surface of the screed plate are arcuate in configuration to inhibit the formation of lay marks in the concrete. The cutting shoe is preferably C-shaped in configuration for enhanced cutting, curling and rolling of cementations material in front of the advancing screed plate resulting in less grading during final finishing. The combination of the wide bearing surface and cutting shoe reduces grating, improves the flatness of the slab, and permits the screed to float on the surface, even with high slump concrete. The screed plate is provided with a plurality of braces connected to the cutting shoe to permit an overall lightweight design, increase screed strength, transfer vibration to the trailing edge of the screed plate for enhanced uniformity of consolidation of the concrete or other cementatious material, and to maintain the angular relationship between the cutting shoe and the bottom bearing surface.

These and other benefits of the present invention will be readily apparent to those skilled in the art with reference to the drawings, specification and claims hereof.

DESCRIPTION OF THE PREFERRED EMBODIMENT

Figures 1, 6, 7:
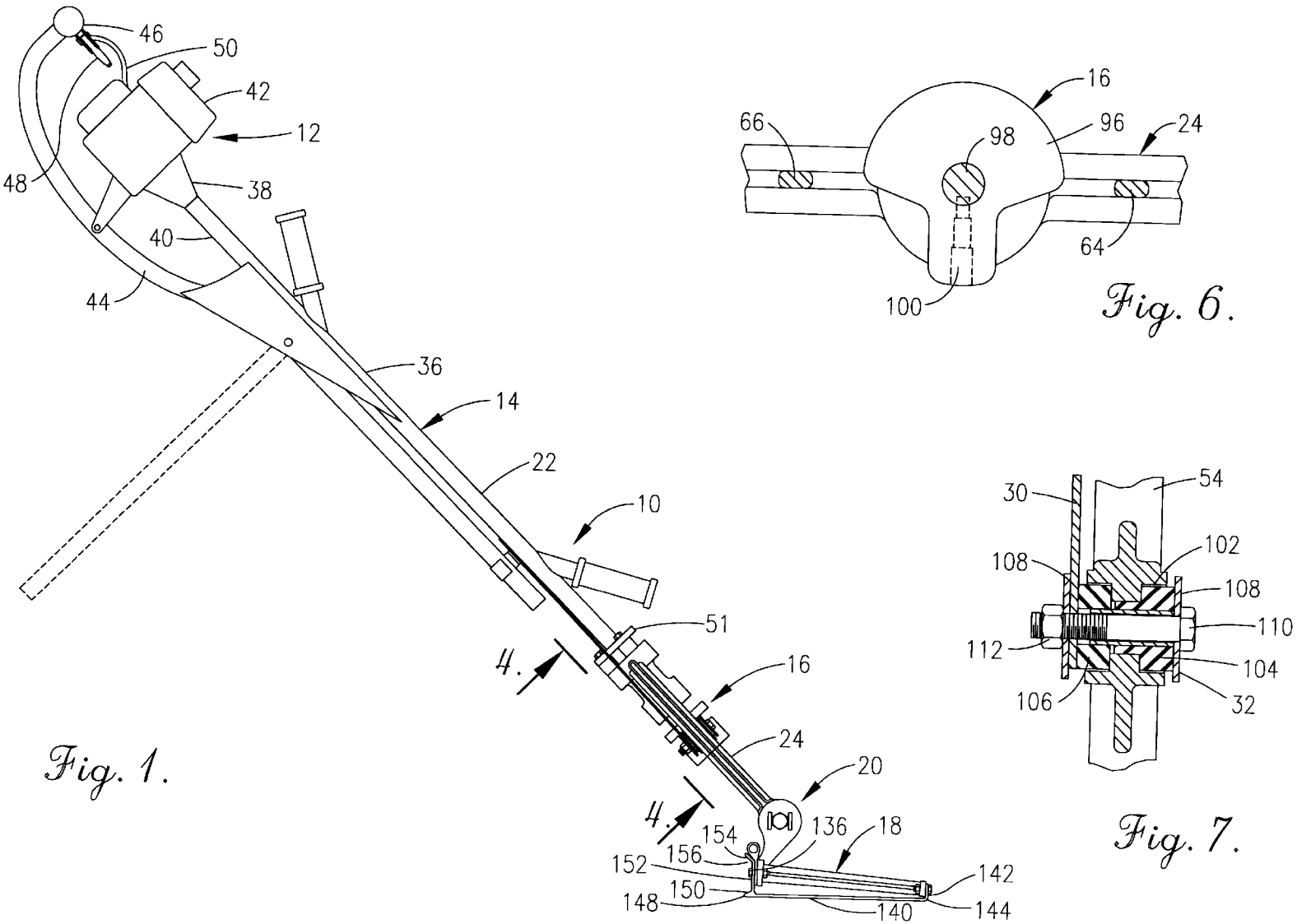
FIG. 1 is a left side elevational view of the vibratory screed of the present invention, showing the motor mounted adjacent the handle at the proximate end of the frame and the screed plate mounted to the locking hinge at the remote end of the frame.
FIG. 6 is an enlarged fragmentary cross sectional view taken along line 6—6 of FIG. 4 showing the positioning of the eccentric within the yoke of the frame.
FIG. 7 is an enlarged fragmentary cross sectional view taken along line 7—7 of FIG. 4 showing one of the shock isolators between the frame yoke and a brace.
Figure 2:
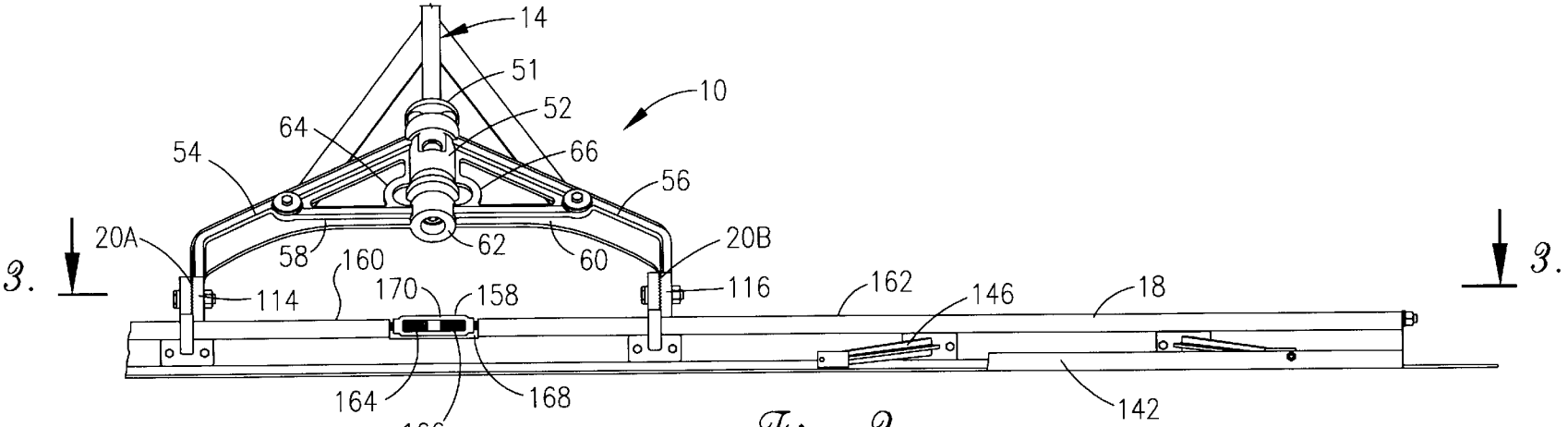
FIG. 2 is an enlarged, fragmentary rear elevational view of the vibratory screed hereof, showing the eccentric and locking hinge for the screed plate.
Figure 3:
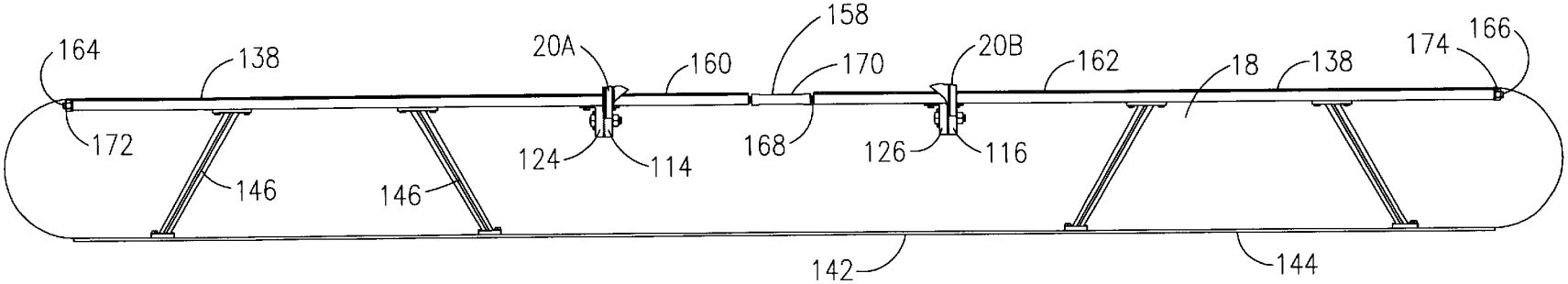
FIG. 3 is a fragmentary top plan view of the vibratory screed showing the screed plate and the locking hinges for selectively adjustably attaching the screed plate to the frame.

Referring now to the drawing, a vibrating screed 10 in accordance with the present invention broadly includes a rotating power supply 12, a frame 14, an eccentric 16 rotatably connected to the power member 12 and carried by the frame, a screed plate 18, and a pair of laterally spaced locking hinges 20A and 20B for selectively and adjustably securing the screed plate 18 to the frame 14 at one of a possible plurality of different angular relationships therebetween.

In greater detail, the frame 14 includes a tubular frame shaft 22 and a frame yoke 24 interconnected by shock mounting 26 and braces 28 and 30 connected respectively to shock isolators 32 and 34. Shock mounting 26 preferably includes three equally spaced rubber double ended threaded bumpers 35. The frame shaft 22 includes straight tube 36 which receives therein a radially ribbed synthetic resin liner, the straight tube 36 presenting a hub 38 for carrying power supply 12 at the proximate end 40 of the vibrating screed 10 nearest the user. Power supply 12 provides rotational power and may be a pneumatic motor connected to pressurized air conduit, an electrical motor connected to an electrical supply cord, or most preferably and as shown, a gasoline engine 42 such as a Robin/Fuji 2 cycle engine or a Honda GX 31 Mini 4 stroke engine supplying 2 horsepower. An arcuate extension 44 extends proximately from the straight tube 36 and is coupled to the engine 42 for support and stability as well as terminating in a transversely oriented graspable handle 46 carrying a throttle toggle lever 48 coupled to the engine 42 by a conventional Bowden cable 50. The remote end of the frame shaft 22 presents a mounting flange 51 to receive threaded bolt shank 69 therethrough for coupling tubular frame shaft 22 to frame yoke 24.

Figure 5:
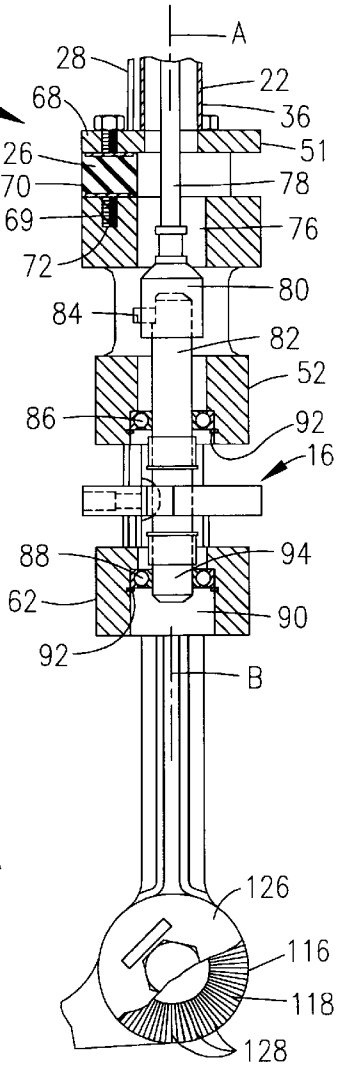
FIG. 5 is an enlarged fragmentary cross sectional view taken along line 5—5 of FIG. 4, showing the shock mountings between the frame shaft and the frame yoke and the bearings and the eccentric journals carried by the frame yoke.

The frame yoke 24 is preferably cast aluminum and includes a central longitudinally oriented tubular body 52, a pair of outwardly diverging arms 54 and 56, a pair of cross members 58 and 60 connecting the arms and the body 52 relatively remotely. The body 52 also has a lower bearing housing 62 with a pair of rails 64 and 66 connecting the upper portion of the body 52 to the lower bearing housing 62. As shown in FIG. 5, the shock mounting 26 includes bolt shanks 68 and 69 which are separated and dampened by rubber bushings 70, the bolts 68 being received into holes 72 drilled and tapped into the proximate end of the body 52. The body 52 includes a transverse window 74, and presents a tubular channel 76 to receive flexible drive shaft 78 therethrough. The drive shaft rotates approximately about axis A. A drive shaft coupling 80 is positioned proximately to eccentric 16 and is located in window 74 for connecting to a proximate upper extension journal 82 on eccentric 16 by setscrew 84.

The body 52 receives within channel 76 an upper high speed bearing 86, such as a ball bearing, with a lower high speed bearing 88 being positioned in a passage 90 longitudinally aligned with channel 76. Each of bearings 86 and 88 are held in place by snap rings 92 received in circumferential grooves within the respective channel 76 and passage 90. The upper bearing 86 receives upper extension journal 82. A lower extension journal 94 extends remotely from eccentric 16 and is received within lower bearing 88. Thus, the eccentric 16 includes off-center weight 96 connected to a central shaft 98 by a set screw 100 as shown in FIG. 6, and is supported on both the proximate and remote sides thereof by journals 82 and 94 rotatably received in bearings 86 and 88 for rotating about axis B which is substantially coincident and thus collinear with axis A.

Figure 4:
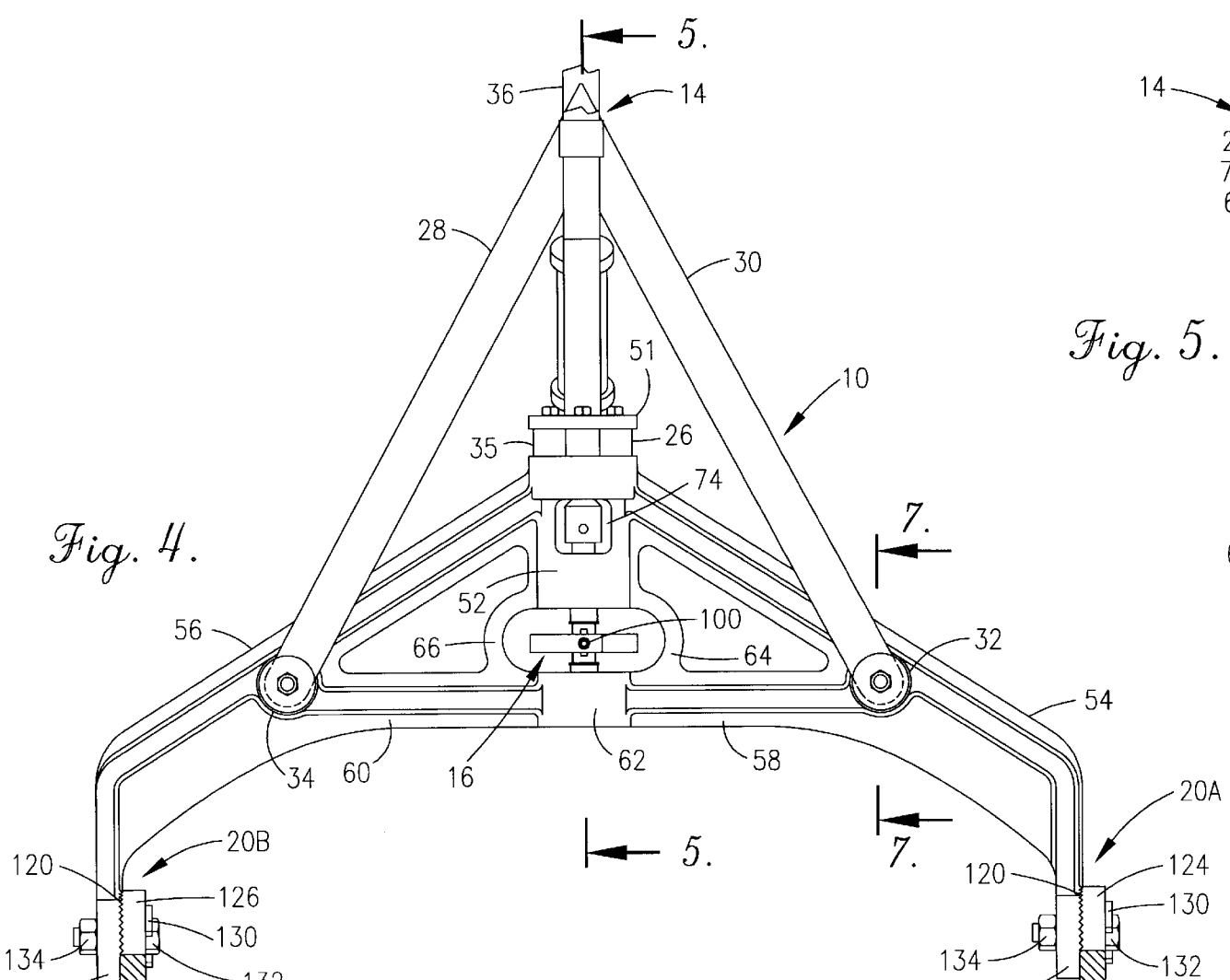
FIG. 4 is an enlarged fragmentary bottom plan view in partial cross section taken through the locking hinges showing the normally lower frame yoke and the locking hinges taken along line 4—4 of FIG. 1.

The arms 54 and 56 receive shock isolators 32 and 34 therein as shown in FIGS. 4 and 7. The isolators 32 and 34 are each received within openings 102 through arms 54 and 56 proximate the intersection of the arms 32 and 34 and the respective cross members 58 and 60. The shock isolators 32 and 34 each include a rubber insert 104 and a plug 106 which are compressed into openings 102 by washers 108. The braces 28 and 30 are in turn attached to the isolators 32 and 34 respectively by bolts 110 and nuts 112 as shown in FIG. 7.

Arms 54 and 56 are provided with respective adjustment connections 114 and 116 at their remote ends, each of the adjustment connections being provided with ridged faces 118 facing inboard to mate with complementally ridged surfaces 120 provided on the outboard facing surfaces 122 of knuckles 124 and 126 as part of locking hinges 20A and 20B respectively. The ridged faces 118 and ridged surfaces 122 each are provided with a plurality of radially oriented circumferentially arrayed teeth 128 as shown in FIGS. 4 and 5 for interlocking engagement to secure the knuckles 124 and 126 to the arms 54 and 56 of the yoke 24. The knuckles 124 and 126 are preferably provided with flanges 130 on one of the sides thereof to retain the head of a bolt 132 against turning. Each of the bolts 132 and their corresponding nuts 134 releasably and adjustably secure the knuckles 124 and 126 to their corresponding adjustment connections 114 and 116.

The screed plate 18 presents a cutting shoe 136 on the proximate end 138, a flat bottom 140, and a trailing flange 142 at the remote end 144. A plurality of transfer braces 146 interconnect the cutting shoe 136 and the trailing flange 142. The cutting shoe 136 includes a lowermost cutting edge 148, an inclined wall 150 oriented normally upwardly and toward the trailing flange, an upright wall 152, and a return wall 154 defining a substantially C-shaped recess 156. A beam tension adjustment 158 includes a pair of laterally spaced transversely oriented tubes 160 and 162 mounted on the cutting shoe 136 for receiving therein a pair of threaded rods 164 and 166. The tubes 160 and 162 have a gap 168 therebetween transversely centrally located one the screed plate to receive a turnbuckle 170 threadably coupled to the threaded rods 164 and 166. Nuts 172 and 174 are threaded onto the ends of the rods 164 and 166 for engaging the ends of the tubes 160 and 162 and thus the cutting shoe 136, whereby a beam tension adjustment 158 is provided. The knuckles 124 and 126 are also mounted on the upright wall 152 of the cutting shoe 136 on either side of gap 168. Advantageously, the frame may be supported when not in use by a spring loaded kick stand which may be retained in a stored position by a support hook carried by tubular frame shaft 22, with the kick stand pivotally mounted on a gusset plate reinforcing extension 44.

In use, the vibrating screed 10 hereof is placed on wet concrete or other cementatious material to be compacted and smoothed. Before such placement, the screed plate 18 may be coated with oil or grease to prevent the concrete from sticking, and to facilitate cleanup. The tension adjustment 176 permits the turnbuckle 170 to be tightened or loosened so that the bottom 140 and cutting edge are substantially flat and level.

The operator then determines whether greater compaction or smoothing action is required for the particular pour in question. This may be determined by the type of aggregate involved, the wetness of the concrete, the temperature, or depth of the pour. When more compaction force is desired, the locking hinge permits the angle between the tubular frame shaft 22 and thus the axis of rotation of the eccentric 16 and the flat bottom 140 of the screed plate 18 to be reduced and fixed. Since the flat bottom 140 will ordinarily be substantially horizontal, the angle between the tubular frame shaft 22 and the horizontal will be reduced to less than 45 degrees incrementally to increase the relative amount of compaction forced to be imparted by the eccentric 16 to the screed plate 18. On the other hand, when more oscillating or smoothing force is to be applied to the concrete, the tubular frame shaft 22 may be raised to thereby increase the angle between the axis of rotation of the eccentric 16 and the flat bottom 140 of the screed plate 18. Such adjustment may be accomplished relatively quickly by simply loosening the bolts 132 and their corresponding nuts 134 to permit disengagement between the knuckles 124 and 126 and their corresponding adjustment connections 114 and 116. When the knuckles are pivoted on bolts 126 to the desired position relative to the adjustment connections 114 and 116, the nuts are retightened on the bolts 126 to bring the ridged faces 118 and ridges surfaces 122 back into mating engagement.

The operation of the vibrating screed 10 is facilitated by the ability to adjust the angular relationship between the screed plate 18 and the frame 14. This permits the operator to stand in an upright position and pull the screed 10 using only the arms and legs, notwithstanding the length of the frame. Furthermore, the lightweight design of the screed 10 makes it easily maneuverable by a single operator notwithstanding screed plate lengths up to 14'. In contrast, other screeds typically necessitate the use of two or more operators with comparable screed lengths and require the operator to assume a bent over or leaning position, causing back strain.

The vibrating screed 10 is then placed on the concrete to be worked, the engine engaged to rotate the eccentric 16, and the vibrating screed pulled by the operator grasping the handle 46. The speed of the eccentric may be increased by the operator using his hand to actuate the throttle lever 48 while pulling on the handle. Because the shock mounting 26 permits the frame shaft 22 to be in substantially the same plane as the frame yoke 24, the operator has a good view of the surface to be worked while the fatigue caused by the rotating eccentric 16 is somewhat reduced. Any final finishing required on the surface may be accomplished by using a bull float to correct any surface blemishes.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. A vibrating screed comprising:

a frame;

an eccentric rotatable about a first axis and mounted on said frame;

a source of rotational power carried by said frame and coupled to said eccentric for rotating said eccentric about said first axis;

a screed plate; and a locking hinge adjustably securing said frame to said screed plate at one of a plurality of selectable angular relationships therebetween whereby said first axis of said eccentric may be varied relative to said screed plate.

2. A vibrating screed as set forth in claim 1, wherein said frame includes first and second bearings for journaling said eccentric therebetween.

3. A vibrating screed as set forth in claim 2, wherein said source of rotational power includes a motor coupled to a drive shaft rotatably driven by said motor about a second axis wherein said first axis of rotation of said eccentric is substantially collinear with said second axis.

4. A vibrating screed as set forth in claim 1, wherein said frame includes a tubular shaft located proximate the operator for mounting said motor and a yoke member located relatively remote from the operator with respect to said tubular shaft, said yoke member presenting a body having a pair of spaced-apart bearings for journaling said eccentric therebetween.

5. A vibrating screed as set forth in claim 4, wherein said tubular member includes a hub and including a shaft received in said tubular member and passing through said hub for rotatably connecting said eccentric to said motor.

6. A vibrating screed as set forth in claim 5, including a shock absorbing mount for connecting said yoke and said shaft in substantially coplanar relationship.

7. A vibrating screed as set forth in claim 5, wherein said body includes a transverse window for permitting connection between said eccentric and said shaft.

8. A vibrating screed as set forth in claim 4, including a pair of braces connected to said tubular member and diverging therefrom for connection with said yoke member.

9. A vibrating screed as set forth in claim 1, including a second locking hinge, each of said locking hinges including a knuckle connected to said screed plate presenting a first plurality of teeth and said frame includes a yoke presenting a pair of arms, each of said arms having an adjustment connection thereon having a face presenting a second plurality of teeth, and a locking member for releasably securing said knuckles to their respective arms of said yoke with said first plurality of teeth in mating engagement with said second plurality of teeth.

10. A vibrating screed as set forth in claim 9, wherein said first plurality of teeth and said second plurality of teeth are radially oriented on their respective knuckles and adjustment connection faces.

11. A vibrating screed as set forth in claim 1, wherein said screed plate includes a tension adjustment including first and second threaded rods interconnected by a turnbuckle.

12. A vibrating screed as set forth in claim 11, wherein said screed plate presents an elongated tubular receiver presenting laterally spaced outboard ends, said threaded rods being received within said tubular receiver and having engagement members for respectively abutting each of said outboard ends.

13. A vibrating screed as set forth in claim 1, wherein said screed plate presents an elongated cutting shoe having a leading cutting edge.

14. A vibrating screed as set forth in claim 13, wherein said cutting shoe is substantially C-shaped.

* * * * *